United States Patent [19]

Warren et al.

[11] 4,374,450

[45] Feb. 22, 1983

[54] METHOD OF MAKING AN IGNITER PLUG WITH NICKEL COATING ON CENTER ELECTRODE

[75] Inventors: Gilbert G. Warren; Colin A. Johnson, both of Sidney, N.Y.

[73] Assignee: The Bendix Corporation, Southfield, Mich.

[21] Appl. No.: 260,456

[22] Filed: May 4, 1981

Related U.S. Application Data

[63] Continuation of Ser. No. 45,042, Jun. 4, 1979, abandoned.

[51] Int. Cl.[3] ..... F23Q 3/70; H01T 13/20

[52] U.S. Cl. ..... 445/7; 313/141

[58] Field of Search ..... 313/139, 141, 130, 142; 29/25.12

[56] References Cited

U.S. PATENT DOCUMENTS

| | | | |
|---|---|---|---|
| 2,391,457 | 12/1945 | Carlson | 313/139 X |
| 2,933,631 | 4/1960 | Logan | 313/141 X |
| 3,017,532 | 1/1962 | Talmey | 313/141 |
| 3,452,235 | 6/1969 | Hallaver et al. | 313/141 X |
| 3,857,145 | 12/1974 | Yamaguchi et al. | 313/141 X |
| 3,890,518 | 6/1965 | Tombs | 313/141 X |
| 3,890,519 | 6/1975 | Chafer et al. | 313/130 |
| 3,984,717 | 10/1976 | Romanowski et al. | 313/141 |

*Primary Examiner*—Palmer C. Demeo

*Attorney, Agent, or Firm*—William G. Kratz, Jr.; Raymond J. Eifler

[57] ABSTRACT

An igniter plug having a center electrode and annular electrode with an air gap therebetween is provided having a nickel coating on the tungsten electrode and a portion of the supporting pin therefor, and a collar situate within a portion of the annular electrode to retain a ceramic sleeve within the air gap.

1 Claim, 1 Drawing Figure

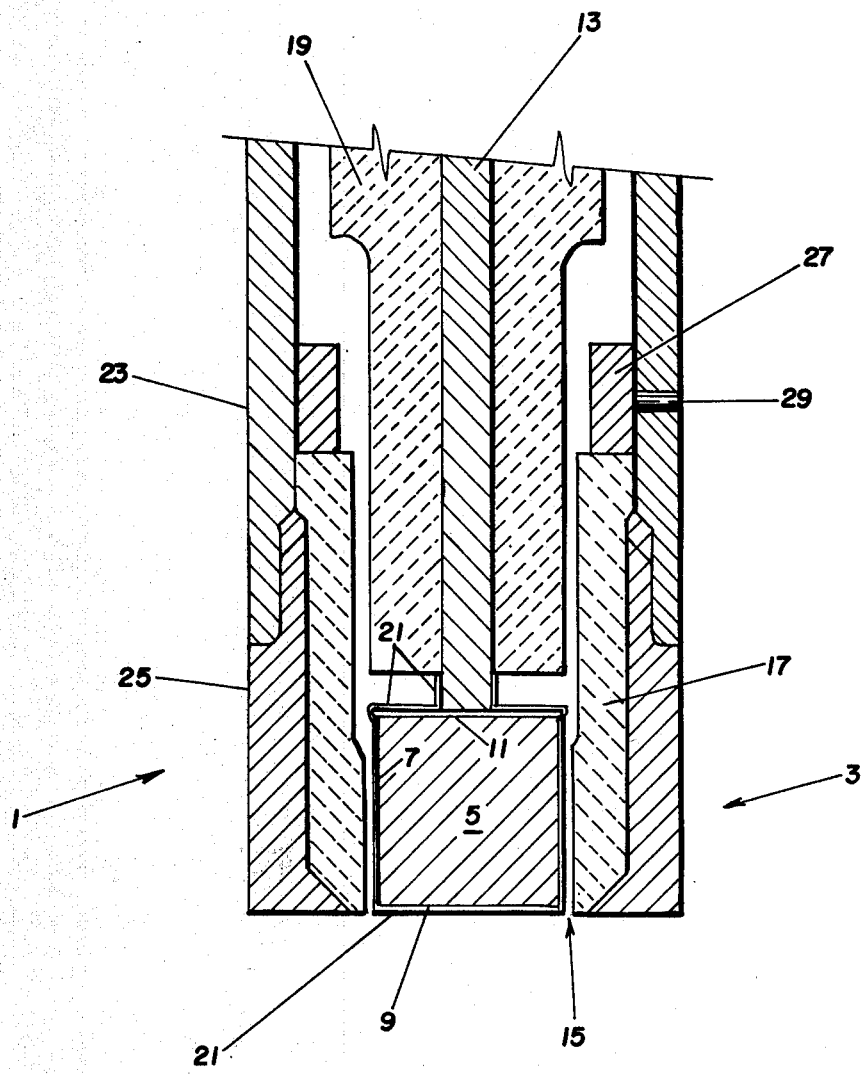
19
13
27
23
29
21
25
17
7
11
3
1
5
21
9
15

METHOD OF MAKING AN IGNITER PLUG WITH NICKEL COATING ON CENTER ELECTRODE

This is a continuation, of application Ser. No. 45,042, filed June 4, 1979, and now abandoned.

BACKGROUND OF THE INVENTION

The present invention relates to an improved igniter plug that will withstand long term use at high temperatures. Generally, igniter plugs are used in engines, such as aircraft engines, to provide the spark for ignition of fuel. Such plugs comprise a central electrode that is composed of tungsten or other conductive material and an outer annular electrode spaced therefrom, to provide an air gap, with conductivity established between the center electrode and an electrical source. The annular electrode generally serves as a ground. A ceramic insulator is provided in the air gap. Upon energizing of the center electrode, a spark is produced across the gap between the center electrode and the annular electrode, which spark ignites the fuel for use in the engine.

The use of tungsten as the material from which the center electrode is formed has been preferred. However, due to the high temperature and environment to which the electrode is subjected during operation of the igniter plug, tungsten oxide is sometimes formed on the electrode surface which causes the electrode surface to expand and exercise forces on the initially spaced ceramic insulator, causing cracks in the insulator top. Such cracks shorten the effective life of the igniter plug.

The problem posed by formation of an oxide film on the surface of the tungsten tip insulator is described in U.S. Pat. No. 3,890,518 wherein an oxidation resistant material, such as silicon or aluminum, is provided over the tungsten part of the inner electrode as a diffused surface layer. The application of the silicon or aluminum coating is effected by surrounding the entire electrode tip with a fine powder of the desired material and heating the assembly for four hours at a temperature of 1060° C. under an argon atmosphere. In that embodiment, the electrode tip is provided with an oxidation resistant layer of diffused silicon by coating the complete tip of a thickness of about 15 microns and the layer is removed from the axial end surface of the tip that is to be connected to the main electrode or pin.

BRIEF SUMMARY OF THE INVENTION

An igniter plug 1 has a center cylindrical electrode 5 of tungsten material that is surrounded by a spaced annular electrode 3. An air gap 15 is provided between the spaced electrodes and a ceramic insulating sleeve 17 is disposed in the air gap between the electrodes. The center electrode 5 is supported by a conductive pin 13 and the center electrode and a portion of the pin are coated with a protective nickel coating 21, so as to prevent growth of tungsten oxide on the electrode surface and thus provide a stable, long life igniter plug. The ceramic insulating sleeve 17 is positioned within the outer electrode sleeve 3 of the igniter plug by means of a collar 27, which is plug-welded to the outer sleeve, to retain the ceramic sleeve while permitting a pin ceramic insulator 19 about the center electrode supporting pin 13 to move axially within the igniter tip.

DESCRIPTION OF THE DRAWING

The drawing is a cross-sectional view of the tip of the igniter plug of the present invention.

DETAILED DESCRIPTION

Referring now to the drawing, there is illustrated an improved igniter plug constructed according to the present invention.

The igniter plug 1, the tip of which is illustrated, comprises an outer or annular electrode or conductive shell 3, preferably of stainless steel and tungsten alloy, and an inner or center electrode 5 of tungsten. The center electrode 5 is of general cylindrical configuration, with a circular wall 7, exposed end 9 and support end 11. The center electrode is supported by a pin or rod 13, which is of an electrically conductive material such as a nickel ferrous alloy, and is attached to the pin by welding or other attachment means.

The annular electrode 3 and center electrode 5 are spaced from each other by an air gap 15. Provided within the air gap 15, intermediate the electrodes 3 and 5, is an insulating sleeve 17. The conductive pin 13 also has thereabout a pin insulating member 19. The insulating sleeve 17 and member 19 are preferably of a ceramic insulating material, such as alumina based ceramic insulators known in the art.

The above described general description of the igniter plug is of conventional design and has certain deficiencies that are corrected by the present claimed improvement.

The present invention provides a coating of nickel completely about the exposed surface of the tungsten electrode. This coating, illustrated as coating 21 in the drawing, provides exceptional stability and long life for the center electrode 5. As illustrated, the nickel coating, in addition to covering the complete surface area of circular wall 7, exposed end 9 and support end 11 of the tungsten electrode 5, also covers a portion of the supporting pin 13 adjacent the center electrode to provide complete encasement of the electrode even at welding points. The thickness of the nickel coating that is deposited on the electrode, such as by electroplating, should be between about 0.001–0.003 inch. Preferably, the thickness of the coating is on the order of 0.002 inch.

The nickel coating in the present invention, at a thickness of 0.001–0.003 inch is applied to the electrode tip and part of the conductive pin by electroplating. Diffusion of the nickel into the tip and the pin is achieved by heating the assembly to a temperature of about 1093° C. under influence of a vacuum, using a maximum pressure of about $1\times10^{-4}$ torr.

Preferably, the conductive shell 3 is comprised of a main shell 23, which is stainless steel, and a shell tip portion 25 which is composed of tungsten alloy, with the two portions attached by brazing. In order to retain the ceramic insulating sleeve 17 within the electrode tip assembly, while still permitting thermal expansion of the same, a collar 27 is provided about the inner circumference of the main shell 23, which collar is affixed to the shell by plug welds 29. With the provision of the collar 27, the main insulator or pin insulating member 19 telescopes freely into the tip insulator 17 but does not firmly abut the latter. Thus, the shell will not be in a longitudinal stress condition during thermal differential contraction when the ignitor cools down from high operating temperatures.

As an example of the benefits of the present invention, wherein the tungsten center electrode has a nickel coating of 0.002 inch thickness over the exposed surface and a portion of the pin supporting the same, such plugs were compared with plugs without such a coating.

A plug according to the present invention was subjected to voltage testing, both dry and wet, using an exciter, followed by ten minutes of sparking with fuel dripped on the tip. This was followed by a further voltage test. Subsequently, the igniter was placed in a test fixture for a heat cycle at 650° C. at the tip lasting five hours, followed by inspection for cracks in the ceramic tip insulator sleeve. This sequence of voltage test, sparking test and temperature test was repeated until fifty hours of the temperature exposure was accomplished. The plug of the present invention completed the full ten cycles of five hours each at 650° C. and showed no cracks in the tip insulator.

A plug without the nickel coating lasted only three cycles of five hours each at 650° C., according to the above test and, after the end of the third cycle, the tip insulator showed two radial cracks and testing was stopped.

The present invention thus provides an igniter plug having a tungsten tip that can withstand high temperature operation without cracking of the tip insulator so as to provide stability and many hours of operation of the igniter plug.

We claim:

1. A method of making an ignitor plug of the type having a cylindrical center electrode of tungsten welded to a center supporting pin of electrically conductive material; an annular electrode surrounding the center electrode and spaced therefrom by an air gap, said annular electrode being comprised of a tungsten alloy in at least a portion thereof proximate the center electrode; and an insulating sleeve intermediate the electrodes, said method characterized by the steps of electroplating with nickel to a thickness of 25 to 75 microns the exposed surface of the center electrode, a portion of the supporting pin adjacent the center electrode and the weld; placing said plated igniter plug in a vacuum chamber having a maximum pressure in said chamber of $1\times10^{-4}$ torr and heating said igniter plug while in said chamber to a temperature above 1,000 degrees centigrade.

* * * * *